United States Patent [19]

Hutcheon

[11] Patent Number: 4,543,509

[45] Date of Patent: Sep. 24, 1985

[54] OFF-AXIS ELECTRON GUN

[75] Inventor: Ronald M. Hutcheon, Deep River, Canada

[73] Assignee: Atomic Energy of Canada Limited, Ottawa, Canada

[21] Appl. No.: 491,400

[22] Filed: May 4, 1983

[30] Foreign Application Priority Data

Dec. 23, 1982 [CA] Canada ..... 418445

[51] Int. Cl.[4] ..... H01J 29/48; H01J 29/62

[52] U.S. Cl. ..... 313/454; 315/5.41; 328/228; 328/233

[58] Field of Search ..... 328/228, 229, 233; 313/230, 454, 341, 453, 455; 315/111.81, 5.24, 5.29, 5.31, 5.42, 5.41

[56] References Cited

U.S. PATENT DOCUMENTS

| | | | |
|---|---|---|---|
| 2,631,234 | 3/1953 | Wideroe | 328/233 X |
| 2,921,214 | 1/1960 | Broad | 313/453 |
| 2,983,839 | 5/1961 | Field | 313/453 X |
| 3,013,179 | 12/1961 | Harris | 315/5.31 X |

*Primary Examiner*—Palmer C. DeMeo
*Attorney, Agent, or Firm*—Edward Rymek

[57] ABSTRACT

The purpose of the off-axis electron gun is to generate a beam of electrons and to deflect the beam onto the axis of a device which utilizes the beam. The off-axis electron gun includes an arcuate wire electron emitting source subtending an azimuthal angle of up to 125°, a non-intercepting azimuthally asymmetric focussing and deflecting electrode located at and around the electron source, and an anode plate with a beam exit hole. The non-intercepting electrode has an arcuate slot subtending a predetermined angle at a predetermined radius from the beam axis in which the arcuate wire electron source is mounted in electrical isolation from the electrode. The deflecting section of the electrode is azimuthally asymmetric in shape such that when selected voltages are applied between the wire source, the focussing and deflecting sections of the non-intercepting electrode and the anode, an electric field is produced which directs the electrons towards the axis, focusses the beam and deflects it onto the axis.

9 Claims, 6 Drawing Figures

OFF-AXIS ELECTRON GUN

BACKGROUND OF THE INVENTION

This invention is directed to electrons guns and, in particular, to off-axis electron guns.

The most common type of electron gun consists of a point source that is surrounded by a focus electrode to focus and drive the electrons in a forward direction through an anode. One example of such a source is disclosed in U.S. Pat. No. 3,694,687, which issued on Sept. 26, 1972. This source would usually be located on the beam axis of the device that uses the electron beam. However, for accelerators such as the one disclosed in U.S. Pat. No. 4,006,422, that issued on Feb. 1, 1977, to Atomic Energy of Canada Limited, in which the beam makes a double pass through the accelerator structure to provide an efficiently accelerated beam within a compact structure, the electron source cannot be located on the beam axis. In this case, a source, with an electrostatic or a magnetic deflector, such as disclosed in U.S. Pat. No. 2,839,706, which issued on June 17, 1958 to G. E. Anderson et al., would be used.

However, in commercial low cost accelerator systems, such as those used in the medical field, it is generally acknowledged that the voltage pulses delivered to the electron gun may vary by up to 5%, which will affect the deflection of the beam by the injection system. In addition, such deflectors do not generally come within the size restrictions imposed on such systems due to the large deflector angle required.

SUMMARY OF THE INVENTION

It is therefore an object of this invention to provide an electron gun for generating a beam accurately directed along an unobstructed beam axis, independent of practical variations in electron energy.

This and other objects are achieved in an electron gun which includes an arcuate electron emitting wire subtending an azimuthal angle of up to 125° that is located a predetermined distance from the beam axis, an anode that is positioned about the beam axis at a predetermined distance from the arcuate wire, and an electrode that is mounted about the arcuate wire and that is azimuthally non-symmetric about the beam axis. When the latter is placed at a negative potential relative to the anode, an electric field which is asymmetric about the beam axis is formed. The electrons emitted from the arcuate wire are initially directed towards the beam axis, focussed to a beam and deflected onto the beam axis before reaching the anode.

In accordance with another aspect of this invention, the asymmetric electrode may include: a first section for directing the emitted electrons toward the beam axis at a predetermined angle; a second section for focussing the emitted electrons into an electron beam; and a third section for deflecting the emitted electrons onto the beam axis. The first section may include an electrical conductor having an arcuate slot wherein the wire is mounted at a predetermined distance within the arcuate slot. The second section may include a bevelled electrically conductive surface extending forward from above the arcuate slot. The third section may include an electrically conductive surface facing the beam axis diametrically opposite the bevelled conductive surface. All of the sections of the further electrode are at the same potential, and are given a small negative bias with respect to the arcuate wire.

In accordance with another aspect of this invention, the slot in the first section may have a width of 4 to 8 diameters of the arcuate wire and the arcuate wire may be positioned a distance of 1 to 2 wire diameters within the slot.

Many other objects and aspects of the invention will be clear from the detailed description of the drawings.

DETAILED DESCRIPTION

Figure 1:
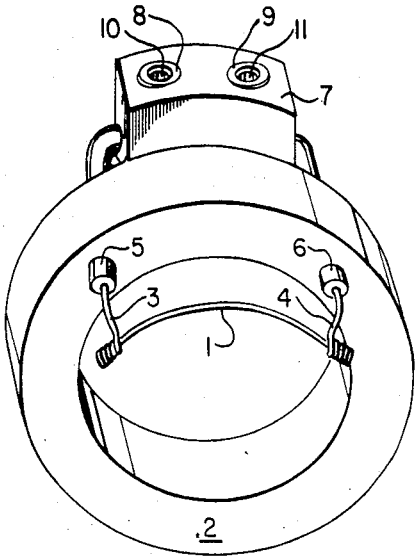
FIG. 1 is a view of the wire electron source mounted on a ceramic ring.
Figure 4:
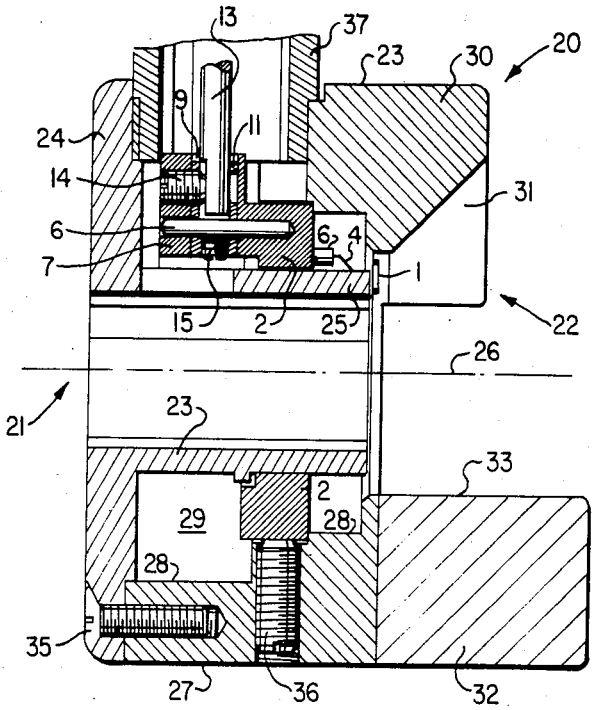
FIG. 4 is a cross-section of the electrode structure taken along line IV—IV.

Referring now to FIGS. 1 and 4, the preferred embodiment of the electron gun in accordance with the present invention, uses as its source of electrons, a partial annulus subtending an arc of up to 125° of a thoriated, carburized tungsten wire 1. Wire 1 is mounted on a ceramic ring 2 by a pair of tantalum wires 3 and 4 which are twisted and crimped to the ends of wire 1. The other ends of wires 3 and 4 are located in the ends of platinum conductors 5 and 6 where they are crimped for good mechanical and electrical contact. The ceramic ring 2, which may be made from a high purity alumina or from MACOR [trademark—a glass ceramic from Corning Glass Works], has an integral mounting element 7 extending out from the back and along a portion of the ring 2. Element 7 has two openings 8 and 9 that are lined with conductive cylindrical sleeves 10 and 11, to receive two leads 12 and 13 that are to be connected to a current source for heating wire 1. As shown in FIG. 4, lead 13 is fixed within the mounting element 7 and in contact with sleeve 11 by a screw 14 on the back of element 7. In addition, conductor 6 passes through the ring 2 into the mounting element 7 and through the sleeve 11. A screw 15 fixes the conductor 6 within the mounting element 15 in contact with sleeve 11. A direct electrical conductive path is thus provided from lead 13 to wire 1. Lead 12 is connected to the other end of wire 1 in the same manner by sleeve 10 in opening 9, conductor 5 and wire 3.

The structure 20, in which the ceramic ring 2 and electron source wire 1 are mounted, also performs the functions of directing the electrons in a particular direction, focussing the electron beam and deflecting the beam onto the desired axis of the device in which the beam is being used. This structure 20 is therefore made from electrically conductive material, and is azimuthally asymmetric about the output beam axis.

Figure 2:
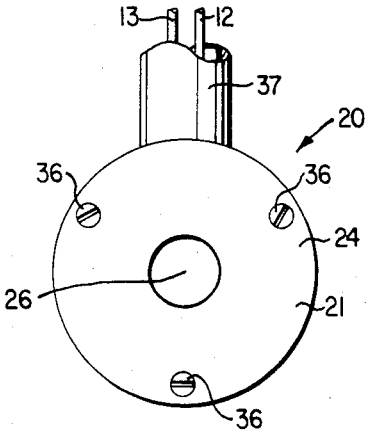
FIG. 2 is a back view of the electron source electrode structure.
Figure 3:
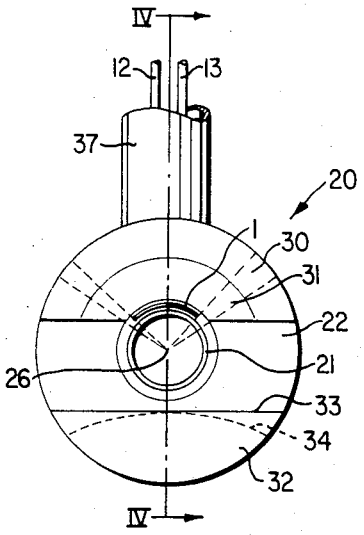
FIG. 3 is a front view of the electron source electrode structure.

In the present embodiment, structure 20 is manufactured in two sections 21 and 22, as shown in FIGS. 2 to 4. Section 21 consists of a cylindrical element 23 and an end cap 24. The ceramic ring 2 slides onto the cylindrical element 23 such that wire 1 is positioned near the end 25 of element 23. The end 25 near the wire 1 assists in directing and focussing the electrons emitted from wire 1. The interior of cylindrical element 23 provides the electron beam passage with beam axis 26 when the gun is mounted on an accelerator or other device.

Section 22 is also cylindrical in form, the outer surface 27 having a relatively constant radius and the inner surface 28 having a stepped radius to provide an annular cavity 29 for ring 2 and its connecting elements. The front of section 23 extends forward from an area near wire 1 and along an arc that is longer than the arc subtended by wire 1. This extension 30 is bevelled at an angle of approximately 45° on the inside 31 toward the wire 1. Diametrically opposite extension 30, section 23 has a further extension 32. Extension 32, which may be made from stainless steel would normally have a planar surface 33 facing the beam axis 26. However, surface 33 may be curved downward from the centre as represented by broken line 34 on FIG. 3. This structure, with extensions 30 and 32, is azimuthally asymmetric about the beam axis 26. When sections 21 and 22 are all at the same potential, the electric fields thus produced will also be asymmetric to control the electron beam emitted from wire 1.

To assemble the electron beam source, end cap 24 is fixed to section 23 by screws 35 or other fastening means. With section 21 fixed to section 22, a locking screw 36 in the body of section 22 can be tightened to solidify the ring 2 within the cavity 29. A conductive tubing 37 encloses the two leads 12 and 13 which have one end fixed in openings 8 and 9 respectively. However, tubing 37 is in electrical contact with both sections 21 and 22, and is used as a third lead for the electron gun.

Figure 5:
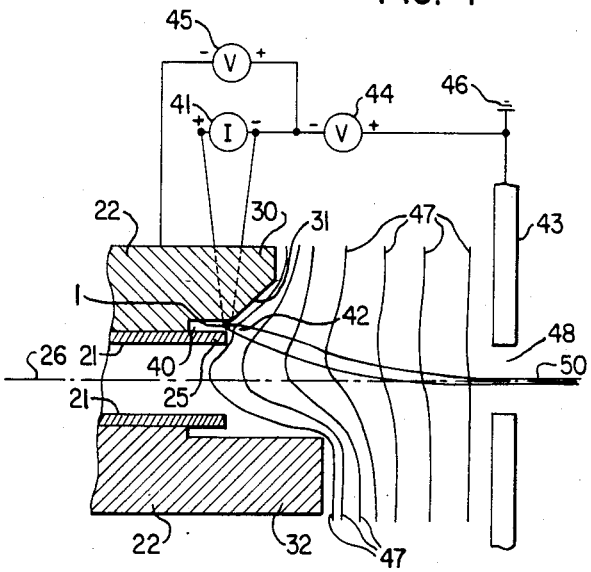
FIG. 5 is a schematic of the electric fields produced in the deflection plane.
Figure 6:
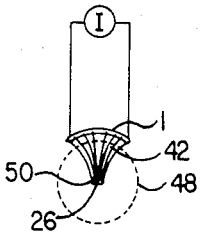
FIG. 6 is a front schematic view of the electron beam being formed, as seen through the anode beam hole.

The operation of the present electron gun is described with reference to FIGS. 5 and 6. The emitter wire 1, which is mounted in a slot 40 formed by sections 21 and 22, is connected to a filament current source 41 that causes it to emit a stream 42 of electrons. In addition the emitter wire 1 is placed at a negative potential relative to anode 43 by a voltage source 44. The electrode sections 21 and 22 are further biased negatively by a small voltage source 45. The anode 43 is connected to ground 46. Because of the shape of the sections 21 and 22, the equipotential lines 47 of the electric field between them and anode 43 are asymmetric which will produce a beam on-axis as it passes through the anode beam hole 48. Voltage sources 44 and 45 will normally be pulse sources as is conventional in the accelerator application.

The current I from source 43, passing through emitter wire 1, will cause electrons to be emitted from it. In view of the small bias voltage between wire 1 and the slot 40, the emitted electrons will be driven out of the slot 40 and be attracted towards anode 43. It is to be noted that the forces applied to the electrons are always in a direction perpendicular to the equipotential lines 47. The depth of wire 1 in the slot 40 will determine the initial thickness of the arcuate stream 42 as it leaves the slot 40. However, a further focussing of the thickness of the stream will occur due to the slight aberration of the electric field at the slot 40 caused by the potential difference between the slot 40 structure and wire 1.

The general direction that the electron stream 42 initially takes as it leaves the slot 40 is determined by the shape of the electric field near the surface 31 of extension 30 on section 22 and the end 25 of section 21. In view of the angle of surface 31, the stream 42 will be directed towards the axis 26, and in view of the arcuate nature of the surface 31, all parts of the arcuate electron stream will be directed towards the axis 26 causing an overall focussing effect. Extension 30 of section 23 therefore acts as the focussing electrode. Finally, the stream 42 is deflected onto the beam axis 26 to form a usable beam 50 whose velocity is in the direction of the beam axis 26. Proper deflection is achieved by the asymmetric field which is produced by extension 32 on section 23. Extension 32 therefore acts as the deflection electrode. It is to be noted that both the focussing electrode and deflector electrode are at the same potential.

In one example, an electron source, in accordance with this invention, was used for a double pass accelerator. It included an emitter wire 1 that had a diameter of 0.25 mm and was bent to form an arc of 125°, the wire was located in a slot 40 so as to be positioned a distance of 7.5 mm from the beam axis 26. The width of slot 40 was 1.5 mm. A filament current of 4.5 amps was applied to wire 1 to produce an emission current of 280 mA. A voltage of −42,000 volts was applied between the emitter wire 1 and the anode, and a further −200 volts bias voltage was applied between the wire 1 and sections 21 and 22. The focussing electrode 30 extended past wire 1 a distance of 6.0 mm, and the deflector electrode 32 extended a distance of 14.7 mm. The anode was placed a distance of 20 mm from the emitter wire 1, at which approximate distance the electron beam 50 was on the beam axis 26 with no radial velocity.

It has been found that for an arcuate wire emitter 1, the optimum depth of the wire 1 in the slot 40 can be in the order of 1 to 2 wire diameters, while the slot width can be in the order of 4 to 8 wire diameters.

The electron gun, in accordance with the present invention, is particularly advantageous since the electric field that accelerates the electrons is also used to deflect the electrons in the desired way. This means that the source of electrons may be placed close to the accelerator axis, that a small deflection angle may be used, and that the deflecting voltage varies as the electron energy varies, circumventing chromatic problems. The wire emitter is oriented at a right angle relative to the plane of the bend of the beam, and thus the width of the beam is minimum in the plane of the bend. This minimizes aberrations and also minimizes the deflection angle, reducing chromatic effects. The focussing electrode can be shaped in the direction at right angles to the bend plane so as to correct for the curvature of the filament, the image of the electron source thus can be a straight line.

Many modifications in the above described embodiment of the invention can be carried out without departing from the scope thereof and, therefore, the scope of the present invention is intended to be limited only by the appended claims.

I claim:

1. An electron gun for producing a beam of electrons directed along a beam axis with the beam current density maximum on the beam axis comprising:

an arcuate wire for emitting electrons, the arcuate wire being a partial annulus subtending an azimuthal angle of up to 125° about the axis at a predetermined distance from the axis, means for directing the emitted electrons towards the beam axis at a predetermined angle, means for focussing the emitted electrons into an electron beam, means for deflecting the emitted electrons onto the beam axis, said directing means, focussing means and deflecting means being at the same potential and producing an asymmetric electric field about the beam axis; and anode means positioned about the beam axis facing the arcuate wire at a predetermined distance along the beam axis.

2. An electron gun as claimed in claim 1 wherein the directing means includes an electrical conductor having an arcuate slot therein, the wire being mounted at a predetermined distance within the arcuate slot.

3. An electron gun as claimed in claim 2 wherein the focussing means includes a bevelled electrically conductive surface extending forward from above the arcuate slot.

4. An electron gun as claimed in claim 3 wherein the deflecting means includes an electrically conductive surface facing the beam axis diametrically opposite the bevelled conductive surface.

5. An electron gun as claimed in claim 4 wherein the directing means electrical conductor, the focussing means bevelled surface and the deflecting means electrically conductive surface are electrically connected together to be at the same potential.

6. An electron gun as claimed in claim 5 which includes a first high negative potential source connected between the arcuate wire and the anode, and a second low negative potential source connected between the directing means electrical conductor and the arcuate wire to negatively bias the directing means electrical conductor.

7. An electron gun as claimed in claim 2 wherein the slot has a width of 4 to 8 diameters of the arcuate wire and the arcuate wire is positioned a distance of 1 to 2 wire diameters within the slot.

8. An electron beam gun for producing a beam of electrons directed along a beam axis with the beam current density maximum on the beam axis, comprising:

an arcuate wire for emitting electrons, the arcuate wire being a partial annulus subtending an azimuthal angle of up to 125° about the beam axis at a predetermined distance from the beam axis;

anode means positioned about the beam axis at a predetermined distance along the beam axis from the arcuate wire, electrode means mounted about the arcuate wire and being at a negative potential relative to the anode to form an electric field asymmetric about the beam axis whereby the electrons emitted from the arcuate wire are directed towards the beam axis, focussed to a beam and deflected onto the axis in the area of the anode means.

9. An electron gun as claimed in claim 8 which includes voltage means connected between the electrode means and the arcuate wire for biasing the electrode means negative with respect to the arcuate wire.

* * * * *